United States Patent [19]

Niebrzydoski

[11] 4,053,542

[45] Oct. 11, 1977

[54] CONTROL MEANS FOR SECONDARY THROTTLE

[75] Inventor: John L. Niebrzydoski, Florissant, Mo.

[73] Assignee: ACF Industries, Inc., New York, N.Y.

[21] Appl. No.: 707,859

[22] Filed: July 22, 1976

[51] Int. Cl.[2] ..... F02M 11/02

[52] U.S. Cl. ..... 261/23 A; 261/39 B; 261/41 C

[58] Field of Search ..... 261/41 C, 39 B, 23 A

[56] References Cited

U.S. PATENT DOCUMENTS

| | | | |
|---|---|---|---|
| 2,328,763 | 9/1943 | Winkler | 261/41 C |
| 3,043,572 | 7/1962 | Ott et al. | 261/23 A |
| 3,059,909 | 10/1962 | Wise | 261/39 B |
| 3,575,385 | 4/1969 | Szwargulski | 261/23 A |
| 3,672,342 | 6/1972 | Ojala | 261/145 |
| 3,726,512 | 4/1973 | Herwig et al. | 261/39 B |
| 3,740,040 | 6/1973 | Brown | 261/23 A |
| 3,791,358 | 2/1974 | Masaki et al. | 261/39 D |
| 3,857,908 | 12/1974 | Brown et al. | 261/121 B |

*Primary Examiner*—Tim R. Miles

[57] ABSTRACT

A multiple stage carburetor has a linkage releasably connecting the secondary throttle for rotation with the primary throttle to open the second stage. A latch member for the linkage is movable between latched and unlatched positions and only when the latch member is in a latched position is the linkage connected for rotation of the secondary throttle. A diaphragm unit operated from a vacuum line to the intake manifold moves the latch member between latched and unlatched positions. A bimetallic element independent of the choke valve controls an air bleed to the vacuum line and is positioned to sense the normal operating temperature of the engine for movement of the latch member to latched position and subsequent opening of the second stage when such temperature is reached.

3 Claims, 6 Drawing Figures

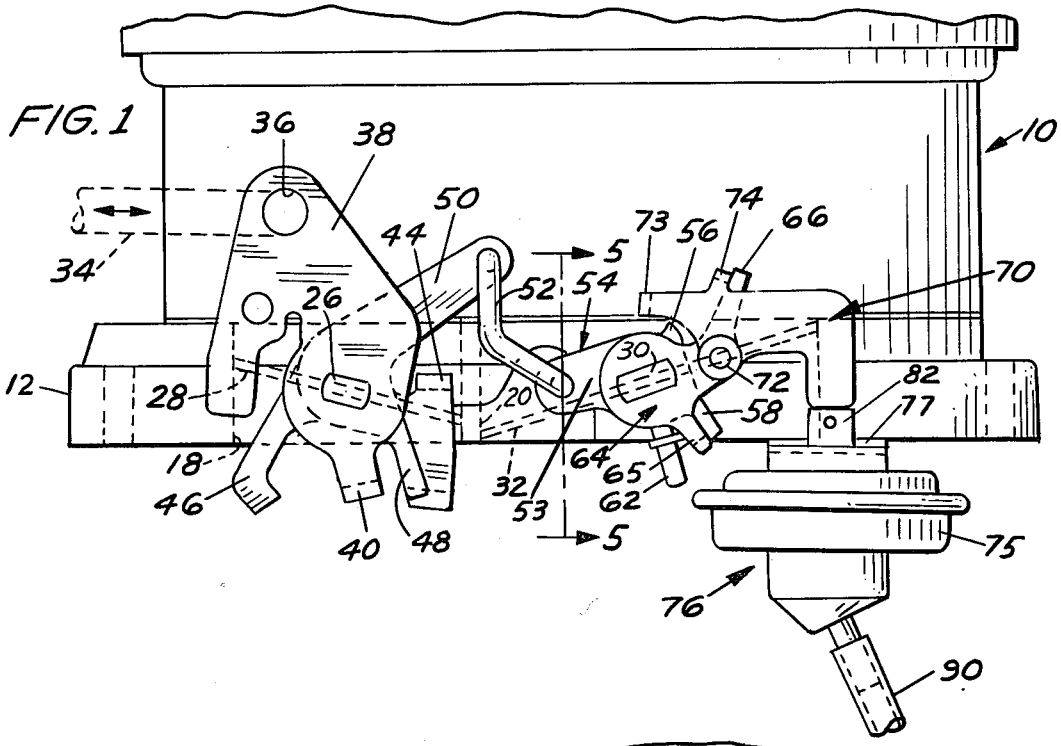
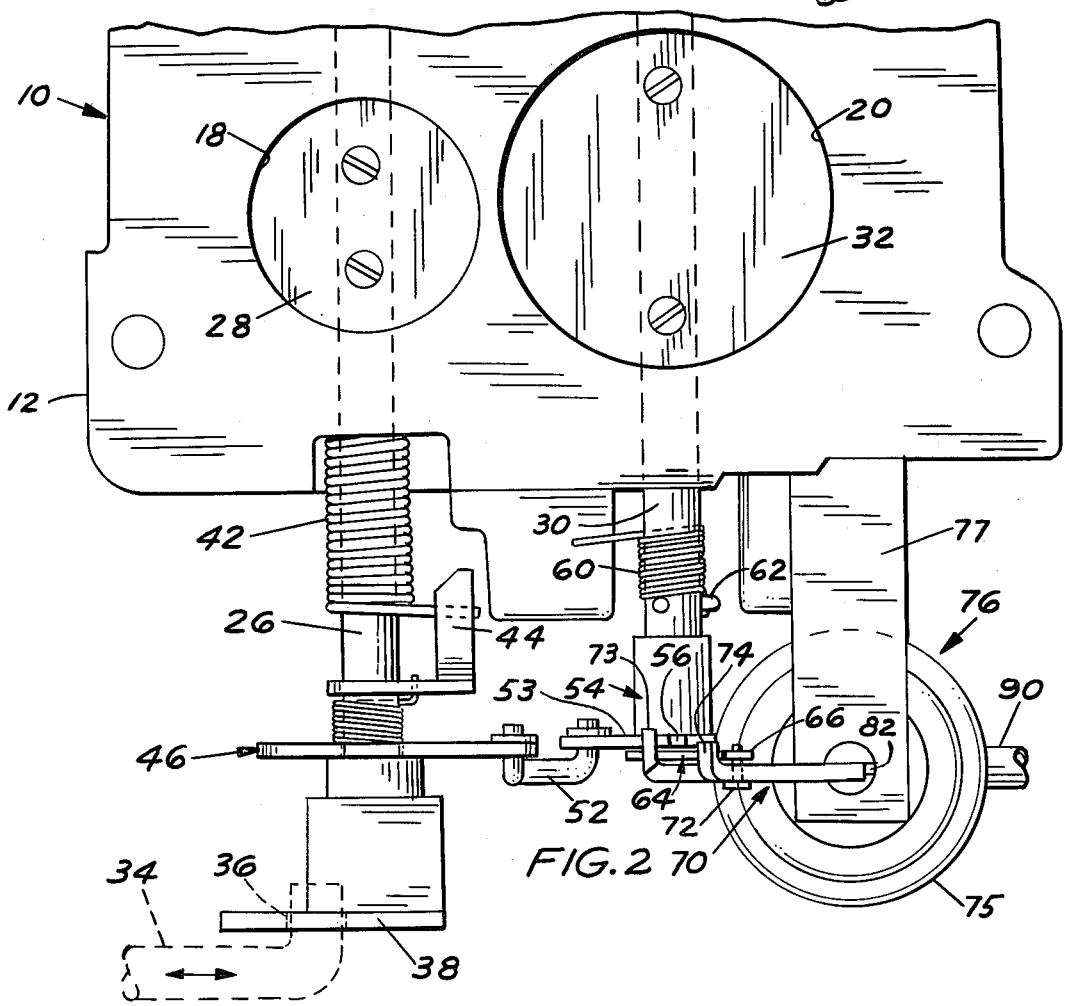
FIG. 2

CONTROL MEANS FOR SECONDARY THROTTLE

BACKGROUND OF THE INVENTION

Heretofore, in four barrel multistage carburetors, a linkage has connected the secondary throttles to the primary throttles with the secondary throttles being opened upon rotation of the primary throttles and in wide open throttle position simulataneously. The linkage heretofore has been disconnected until the choke valves have been opened at which time the linkage has been connected for opening of the secondary stage. When the engine has been cold the linkage has been disconnected and thus the secondary throttles are prevented from opening.

However, with the addition of pollution control devices on internal combustion engines for optimum exhaust emissions, the choke valve is opened early and oftentimes before the engine has reached its normal or optimum operating temperature. When this occurs, the secondary throttles can be opened prematurely which results in a heavy engine load before the engines has reached its normal operating temperature. This could possibly cause engine malfunction and effect engine life.

An example of a multistage carburetor in which a linkage has been provided between the primary and secondary throttles and responsive to the opening of the choke valve is illustrated in U. S. Pat. No. 3,575,385, dated Apr. 20, 1971. The movement of the choke valve to full open position moves the latch to a latched position thereby to connect the linkage between the primary and secondary throttle valves for rotation of the secondary throttle valves to an open position.

DESCRIPTION OF THE PRESENT INVENTION

The present invention is directed to a multiple stage carburetor (four barrel or staged two barrel) in which a latch member for the linkage between the primary and secondary throttles is not connected to or dependent on the choke valve in any manner. The latch member is movable between latched and unlatched positions and only when the latch member is in a latched position is the linkage connected for opening of the secondary throttle valve. A bimetallic element is employed to sense the normal operating temperature of the engine and can be positioned at any desired location, such as within a heated arir cleaner, as shown in the drawings, or within the water jacket, for example. A diaphragm unit is provided for actuation of the latch member and the diaphragm unit is connected by a vacuum line to the intake manifold. An air bleed in the line from the manifold vacuum to the diaphragm unit has a metering valve connected to the bimetallic element and upon an increased in temperature the metering valve is moved to permit an increase in the air being bled within the vacuum line to the diaphragm thereby to actuate the diaphragm unit for movement of the latch member into latched position for operation of the secondary throttle valve upon the rotation of the primary throttle valve. Thus, the secondary throttle valve is not opened until optimum engine temperature is reached, regardless of the position of the choke valve.

It is an object of the present invention to provide a multiple stage carburetor having a linkage between the primary and secondary throttle valves which is connected by a latch member to effect opening of the secondary throttle valve only when the engine is sufficiently warm to permit opening of the secondary throttle valve without malfunction.

It is a further object of the invention to provide a multiple stage carburetor having a thermostatic element controlling movement of a latch member for effecting opening of the second stage thereby to delay the opening of the second stage until an engine temperature is reached sufficiently warm enough so as to prevent engine malfunction and extend engine life.

BRIEF DESCRIPTION OF THE DRAWINGS

FIG. 1 is a side elevation of a portion of a carburetor showing the linkage for the primary and secondary throttle valves with the latch member in an unlatched position;

FIG. 2 is a top plan of the throttle body portion of FIG. 1 showing the linkage between the primary and secondary throttle shafts;

Corresponding reference characters indicate corresponding parts throughout the several views of the drawings.

Figure 3:
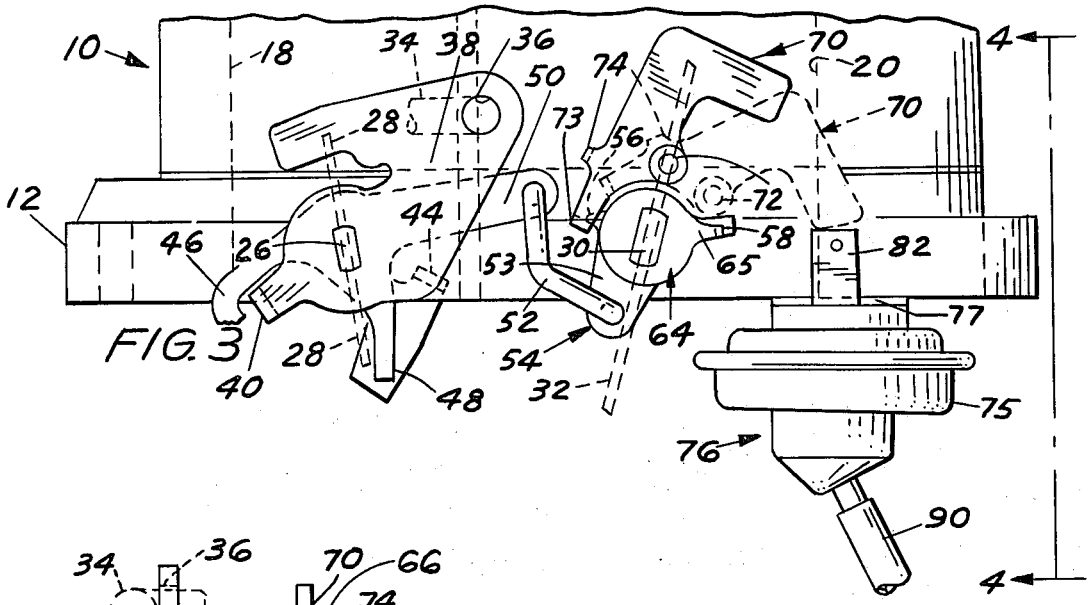
FIG. 3 is a side elevation similar to FIG. 1 but showing the primary and secondary throttle valves in a wide open throttle position with the latch member in a latched position and rotated out of contact with the operating rod of a diaphragm unit.

Referring to the drawings, the invention is illustrated as a multiple barrel, multiple stage carburetor generally indicated 10 of the type commonly referred to as a four-barrel carburetor. Carburetor 10 has a flanged end portion 12 which may be connected to an intake manifold structure 14 of an internal combustion engine shown schematically in FIG. 6. The upper end of the carburetor 10 has an air horn mounting an air cleaner or filter generally indicated at 16 in FIG. 6. Primary air and fuel mixture conduits 18 are provided in carburetor 10 and secondary air and fuel mixture conduits 20 are likewise provided. A choke valve 22 is mounted across primary mixture 18 and an air valve 24 is mounted across secondary conduit 20. A primary throttle shaft is indicated at 26 and has a pair of throttle valves 28 secured thereon. A secondary throttle shaft 30 has a pair of secondary throttle valves 32 secured thereon and mounted within secondary conduits 20. A throttle rod indicated generally at 34 is connected adjacent one end to a suitable foot pedal (not shown) and has its other end inturned and mounted within an opening 36 in a throttle lever 38 secured to primary throttle shaft 26. Throttle lever 38 has an inturned lug 40 thereon. A torsion spring 42 has an end engaging an arm 44 secured to shaft 26 for continuously urging shaft 26 in a counterclockwise direction to close throttle valve 28. A lever generally indicated at 46 is mounted for relative rotative movement about main throttle shaft 26 and includes a lower leg 46 spaced from lug 40 and a second leg 48 extending downwardly therefrom and likewise spaced from lug 40. Inturned lug 40 positioned between legs 46 and 48 extends into the vertical plane defined by legs 46 and 48 and is spaced therefrom in the closed position of throttle valves 28 and 32 as shown in FIGS. 1 and 2. Lever 46 also includes an upwardly extending arm 50 having a bent rod 52 with an upper inturned end pivotally connected thereto. Bent rod 52 has its lower end inturned and pivotally connected to an arm 53 of a sleeve 54 which is mounted about secondary throttle shaft 30 for relative rotational movement. Sleeve 54 also has an integral upwardly extending projection 56 and a downwardly extending lower leg 58. A torsion spring 60 has an end thereof engaging pin 62 fixed to throttle shaft 30 urging throttle shaft 30 in a clockwise position to a closed position of secondary throttle valve 32.

A secondary throttle lever generally indicated at 64 is secured to throttle shaft 30 and has an inturned tang 65 thereon in engagement with lower leg 58 on sleeve 54. Throttle lever 64 has an integral upwardly extending arm 66 thereon.

A releasable latch member is generally indicated at 70. Latch member 70 is supported on throttle lever 64 about pin 72 for relative pivotal movement. Latch member 70 has an inner inturned finger 73 normally spaced from projection 56 in the unlatched position as shown in FIGS. 1 and 2. A second inturned finger 74 of latch member 70 is disposed adjacent upwardly extending arm 66 and acts as a stop to limit the clockwise movement of latch member 70. Latch member 70 is weighted so that it will pivot by gravity in a clockwise direction viewing FIG. 1 when out of engagement with arm 66 limiting the pivotal movement of latch member 70.

Mounted beneath latch member 70 to move latch member 70 between a latched position as shown in FIG. 3 and an unlatched position as shown in solid lines in FIGS. 1 and 2, is a diaphragm unit generally indicated at 76. Diaphragm unit 76 has an outer housing 75 secured by a bracket arm 77 to the underside of carburetor 10. Diaphragm unit 76 has a flexible diaphragm 78 fixed between a pair of plates 80. An operating rod 82 having its upper extending end in engagement with the underside of latch member 70 is secured adjacent its lower end to plates 80. A spring 84 is mounted within housing 75 and is biased between housing 75 and lower plate 80 to urge diaphragm 78 and operating rod 82 upwardly continuously. An upper chamber 86 in housing 75 is open to atmosphere and a lower chamber 88 is sealed from atmosphere. A vacuum line 90 from chamber 88 to a vacuum port 92 exposed to the intake manifold thereby to expose diaphragm 78 to the vacuum from the intake manifold.

Figure 6:
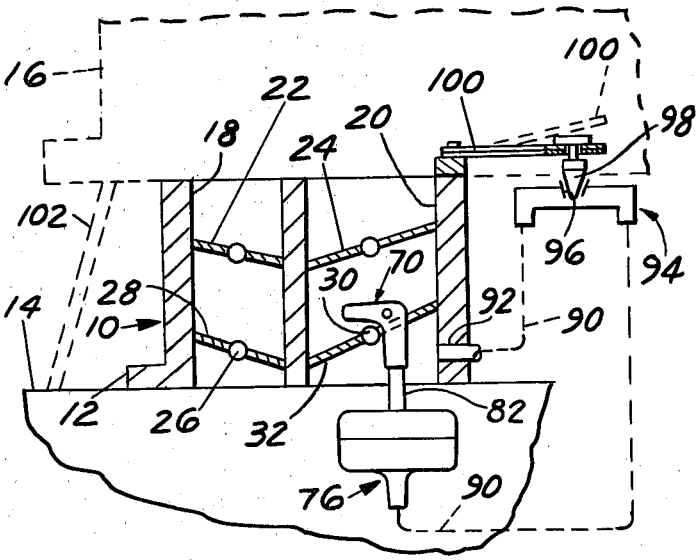
FIG.6 is a schematic illustrating a bimetallic thermostatic element controlling an air bleed into a vacuum line between the intake manifold vacuum and the diaphragm unit for actuation of the diaphragm unit.

Mounted within vacuum line 90 is an air bleed generally indicated at 94 having an opening 96 therein, and an air metering valve 98 to control the flow of air from the atmosphere to vacuum line 90 as shown in FIG. 6. Air metering valve or needle 98 is controlled by a bimetallic thermostatic element or blade generally indicated at 100 as shown schematically in FIG. 6. Bimetallic blade 100 is riveted adjacent one end thereof to a support arranged within air filter or cleaner 16. Heated air from the exhaust manifold is supplied through a line 102 to air cleaner 16 for heating the air supplied to carburetor 10. When the temperature of the air in air cleaner 16 reaches a predetermined amount and is indicative of the normal operating temperature of the engine, bimetallic element 100 is moved to the broken line position shown thereof to thereby open air bleed 96 to atmosphere to increase the air pressure within chamber 88. The increase in air pressure within line 90 results in the upward movement of diaphragm 78 and operating rod 82 to move latch member 70 into a latched position.

Figure 4:
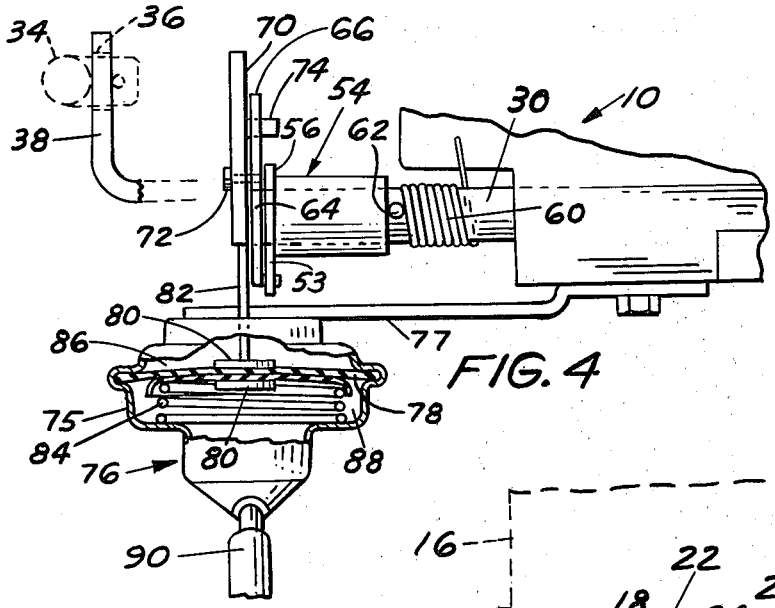
FIG. 4 is an elevation looking generally along line 4—4 of FIG. 3.
Figure 5:
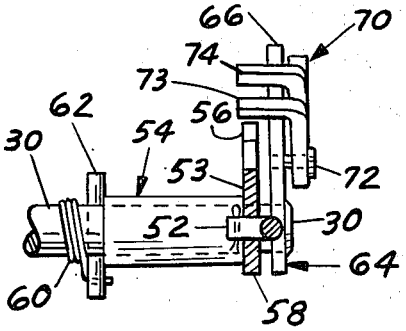
FIG. 5 is a section taken generally along a line 5—5 of FIG. 1.

In operation, as shown in FIGS. 1 and 2 in the unlatched position with diaphragm 78 and operating rod 82 in the position of FIG. 4 inturned finger 73 of latch member 70 is raised above projection 56. In this position, clockwise rotation of throttle shaft 26 from throttle lever 38 results in lug 40 engaging leg 46 to rotate lever 50 in a clockwise direction and sleeve 54 in a counterclockwise direction. Projection 56 moves under finger 73 relative to secondary throttle shaft 30 and in the unlatched position in FIGS. 1 and 2, secondary throttle shaft 30 is not rotated. Thus, secondary throttle valve 32 remains in a closed position.

However, after the engine has been started and warms up, bimetallic blade 100 is heated by the air in air cleaner 16 and moves to the broken line position thereof indicated in FIG. 6. In this position, air is bled into line 90 which increases the pressure within chamber 88 and results in the upward movement of diaphragm 78 and operating rod 82. Operating rod 82 engages latch 70 and pivots latch 70 in a counterclockwise direction with inturned finger 73 placed in the rotative path of projection 56. Therefore, upon rotation of primary throttle shaft 26 and downward or clockwise movement of lever 50, sleeve 54 moves in a counterclockwise direction and projection 56 thereon engages intured finger 73. Since secondary throttle lever 64 is connected about pin 72 to latch member 70, throttle lever 64 is rotated with latch member 70 thereby to rotate secondary throttle shaft 30 for opening throttle valve 32 as shown in FIG. 3. In the wide open throttle position as shown in FIG. 3, latch member 70 is moved out of contact with operating rod 82. However, operating rod 82 remains in position to maintain latch member 70 in the latched position as long as blade 100 is in the broken line position thereof resulting from the heated condition of air cleaner 16.

While bimetalic element 100 has been indicated as sensing the temperature in the air cleaner, it is understood that blade 100 could be located in other desired engine locations such as in the water jacket to sense the temperature of the water or in a location to sense the temperature of the oil. It is noted that the present system is not connected or related to the operation of the choke valves 22 and 24 in any manner, and the position of choke valves 22 and 24 has no bearing on the operation of latch member 70.

What is claimed is:

1. In a multiple stage carburetor for an internal combustion engine, a primary mixture conduit having a primary throttle valve therein and a secondary mixture conduit having a secondary throttle valve therein, primary and secondary throttle shafts on which the primary and secondary throttle valves are mounted, a linkage releasably connecting the primary and secondary throttle shafts for rotation including a latch member for the linkage movable to a latched position to connect the linkage for sequential opening of the secondary throttle valve; the improvement comprising a diaphragm motor operatively connected to the latch member to move the latch member to a latched position, a vacuum line connected to the diaphragm motor and in fluid communication with the intake manifold vacuum, an air bleed in the vacuum line including an air bleed valve member, and a temperature responsive bimetallic element operatively connected to the air bleed valve member to control the amount of air bled into the vacuum line, said bimetallic element responsive to a predetermined high engine operating temperature and being actuated upon reaching the desired engine operating temperature to increase the amount of air bled into the vacuum line and effect movement of the latch member to latched position to permit opening of the secondary throttle valve.

2. In a multiple stage carburetor as set forth in claim 1 wherein said diaphragm motor is mounted on the carburetor and comprises a housing, a diaphragm mounted within the housing having a vacuum chamber on one side thereof in fluid communication with the vacuum line, an operating rod secured to the diaphragm for movement therewith extending from the side of the housing opposite the vacuum chamber and being connected to the latch member for movement of the latch member to latched position.

3. In a multiple stage carburetor as set forth in claim 1 wherein said bimetallic element is exposed to heated air from an air cleaner connected to the carburetor.

* * * * *